US009267278B1

(12) United States Patent
Gibson

(10) Patent No.: US 9,267,278 B1
(45) Date of Patent: Feb. 23, 2016

(54) MODULAR LANDSCAPING AND WATERPROOFING SYSTEM

(71) Applicant: James Gibson, Columbus, OH (US)

(72) Inventor: James Gibson, Columbus, OH (US)

( * ) Notice: Subject to any disclaimer, the term of this patent is extended or adjusted under 35 U.S.C. 154(b) by 0 days.

(21) Appl. No.: 14/750,014

(22) Filed: Jun. 25, 2015

Related U.S. Application Data

(60) Provisional application No. 62/040,281, filed on Aug. 21, 2014.

(51) Int. Cl.
*E04B 1/64* (2006.01)
*E02D 31/06* (2006.01)

(52) U.S. Cl.
CPC .. *E04B 1/64* (2013.01); *E02D 31/06* (2013.01)

(58) Field of Classification Search
CPC ..... A01G 1/08; A01G 13/0256; E02D 31/06; E04B 1/64
USPC ..... 52/169.5; 47/32, 32.7, 33
See application file for complete search history.

(56) References Cited

U.S. PATENT DOCUMENTS 3,745,701 A * 7/1973 Marvin ..... E01C 11/227 256/19
3,761,603 A * 9/1973 Hays ..... H02G 3/045 138/157
3,803,760 A * 4/1974 Matvey ..... A01G 1/08 47/33
4,463,529 A * 8/1984 Singer ..... E02D 31/02 405/229
4,663,883 A * 5/1987 Hilliard ..... A01G 1/08 47/33
4,698,943 A 10/1987 Wieland
4,831,776 A * 5/1989 Fritch ..... A01G 1/08 404/102
RE33,550 E * 3/1991 Jones ..... E01C 11/221 404/7
5,080,004 A * 1/1992 Francis ..... B08B 9/0495 405/43
5,092,076 A * 3/1992 Terreta ..... A01G 1/08 47/33
5,111,627 A * 5/1992 Brown ..... E04F 15/02005 52/126.5
5,157,867 A * 10/1992 Fritch ..... A01G 1/08 404/102
5,495,696 A * 3/1996 Repka ..... E02D 31/02 405/229
5,501,044 A * 3/1996 Janesky ..... E04B 1/7023 404/4
5,568,994 A * 10/1996 Dawson ..... A01G 1/08 404/7
5,765,323 A * 6/1998 Bevilacqua ..... E04B 1/7023 138/157
5,794,388 A * 8/1998 Jackman ..... E04B 1/7023 405/36
5,810,510 A * 9/1998 Urriola ..... E02B 11/005 137/236.1
5,819,466 A * 10/1998 Aesch ..... A01M 1/245 43/123
5,836,115 A * 11/1998 Clay ..... E02D 31/02 405/38
5,926,999 A * 7/1999 Vernon ..... A01G 1/08 43/121
6,012,254 A * 1/2000 Gaston ..... A01G 1/08 47/33
6,027,283 A * 2/2000 Schweinberg ..... E01C 11/227 404/4
6,226,934 B1 * 5/2001 Gaston ..... A01G 1/08 47/33

(Continued)

*Primary Examiner* — Ryan Kwiecinski
*Assistant Examiner* — Alp Akbasli
(74) *Attorney, Agent, or Firm* — Porter Wright Morris & Arthur LLP

(57) ABSTRACT

A device and method for keeping rain water away from the foundation of a structure while providing a decorative border.

17 Claims, 5 Drawing Sheets

(56) References Cited

U.S. PATENT DOCUMENTS 6,230,468 B1 * 5/2001 Klaus ..... E02D 31/06 405/39
6,539,684 B1 * 4/2003 Graham ..... E02D 29/025 405/284
6,625,925 B1 * 9/2003 Foster ..... A01G 1/08 47/33
6,663,323 B1 * 12/2003 Boys ..... E02D 29/0225 405/262
6,767,159 B2 * 7/2004 Jones ..... E01C 11/221 404/7
7,156,587 B2 * 1/2007 Kang ..... C09K 17/00 405/302.6
8,266,849 B2 * 9/2012 Bravo ..... E04F 15/02 52/177
8,312,682 B2 * 11/2012 Trotter ..... E02D 31/02 52/169.5
8,322,087 B1 * 12/2012 Lascano ..... E02D 31/002 404/7
8,505,131 B2 * 8/2013 Doolittle ..... E03F 5/0408 4/613
8,540,456 B2 * 9/2013 Marshall ..... B65D 90/24 405/107
8,820,013 B2 * 9/2014 Fennell ..... E02D 31/02 52/169.5
8,904,706 B1 * 12/2014 Smith ..... A01G 9/027 47/65.6
9,045,874 B1 * 6/2015 Kondas ..... E03F 1/002
9,057,200 B2 * 6/2015 Putnam ..... E04F 11/17
9,109,337 B2 * 8/2015 Wink ..... A01G 1/08
2004/0005192 A1 * 1/2004 Chapek ..... E03F 1/002 405/39
2006/0236601 A1 * 10/2006 Barber ..... A01G 1/08 47/33
2007/0119002 A1 * 5/2007 Baranoff ..... E01C 9/086 14/69.5
2008/0308476 A1 * 12/2008 Silverstein ..... E03F 5/0407 210/163
2009/0223121 A1 * 9/2009 Jones ..... E01C 11/221 47/33
2009/0282754 A1 * 11/2009 Watson ..... E02D 27/01 52/169.6
2009/0290936 A1 * 11/2009 Underwood ..... E03F 1/002 405/39
2010/0247236 A1 * 9/2010 Bradbeer ..... E03F 3/046 404/4
2010/0300019 A1 * 12/2010 Lowe ..... E03F 1/005 52/173.1
2012/0000546 A1 * 1/2012 Lewis ..... E03B 1/04 137/15.01
2012/0060433 A1 * 3/2012 Chandler ..... E04B 1/7023 52/169.5
2012/0201603 A1 * 8/2012 Boulton ..... E03F 1/005 405/36
2014/0138307 A1 * 5/2014 Coffman ..... C02F 3/327 210/602

* cited by examiner

MODULAR LANDSCAPING AND WATERPROOFING SYSTEM

CROSS REFERENCE TO RELATED APPLICATION

This application claims priority to U.S. Provisional Application No. 62/040,281, filed Aug. 21, 2014, the entirety of which is incorporated herein by reference.

TECHNICAL FIELD

The invention relates generally to draining rain away from a foundation of a building and specifically to providing a modular system around the foundation of a house that provides a decorative element that eliminates mulching. The invention can be used as either a drainage system or an alternative to landscaping.

BACKGROUND

Many areas around the country and in particular Columbus, Ohio, have drainage problems causing wet basements. Moisture causes mold and mildew growth as well as cracks in the foundation. Gutters sometimes cannot handle large amounts of rain overflow and drip water near the foundation. Overhanging eaves address this problem by directing rainwater further away from a building. Overflowing gutters create trenches where soil has washed away under the building eaves due to roof runoff spillage. Some homes or buildings have erosion problems or ground with the grade running to the house requiring backfill with dirt and landscaping to cause the water to drain away from the building to keep the basement or crawl space dry. Hauling dirt and moving it against the building to create a slope does not always fix a wet basement. In addition, after getting the proper slope to make the water to run from the house or building, the area typically requires grass or plant landscaping to make the area more attractive.

What is needed is a modular landscaped drain that is aesthetically pleasing. There is a need for a modular drain system that resembles landscaping.

The advantage of the invention over present systems is that it both keeps rain water away from a basement or crawlspace while providing a permanent, attractive transition from the side of the house to the ground. Other advantages include not replacing mulch every season, eliminating weeds and insects that invade mulch and or rock. When cleaning the landscape areas after mowing the grass, mulch or small rocks will be blown by a blower into the lawn. By having such landscaping elements permanently affixed to a surface, the mulch, pebbles, rock, slate, and the like, would stay in place. A further advantage is that the units are sectional, so a section could be removed for planting a flower, shrubs, trees, fountains, large rock, and the like, or only placed where the owner desires. The invention could be installed with a new build or later, and could be changed as the homeowner desired. The pre-manufactured landscape modules lowering maintenance cost for edging, weeding, mulching and the like.

SUMMARY OF THE INVENTION

The invention is a modular landscaping and waterproofing system comprising a plurality of units adapted to be interconnected in a side by side relationship to form a continuous upper surface that diverts rain water from a foundation of a structure. The units comprise a panel and a frame. The panel forms the upper surface. The panel comprises a waterproof barrier layer, a feature, and releasable coupling means. The panel has a first end and a second end. The second end is connected to a drain section. In an embodiment, the drain section is covered. The coupling means interconnects the panels to form a continuous seamless surface. The coupling means comprises a male coupling part and a female coupling part. In an embodiment, the male coupling part is molded on a first side of the panel and the female coupling part is a slot in the opposite side of the panel and the panels are connected in a side by side fashion. The panel is fabricated from a plastic, a cementitious material, a metal and a solar panel. The feature is outward facing and formed to resemble a landscaping element such as mulch, rocks, pebbles, bricks, patterned cement, slate, stucco and the like. In an embodiment, a plurality of channels are created by the configuration of the feature to direct the water to flow into a plurality of holes in the cover of the drain section.

In an embodiment, the panel comprises an opening shaped to allow a plant rooted in the ground to receive sunlight and rain. Each drain section has a male end and a female end, and, when the surface panels are connected, the male end of a first panel interconnects with the female end of a second panel to form a conduit at the base of the surface panels.

In an embodiment, the panel further comprises an electrical circuit. In an embodiment, the panel comprises a light emitting unit connected to the electrical circuit.

The frame is angled from a top part to a bottom part and shaped so that when the panel is placed on the frame, the first end of the panel is adjacent to the outside of the structure at a preselected elevation from ground level and the second end of the panel is near the ground at a preselected distance from the structure. The frame comprises releasable connection means to interconnect a first frame to two adjoining frames on either side of the unit. The connection means is any easily releasable connector, such as magnets, hooks, clamps, clips, clasps, straps, screws, and nut and bolts.

As used herein, the term "about" is meant to include ±1-10% of the value. Terms such as "top," "bottom," "right," "left," "above", "under", "side" "front", "below" "upper", "back" and the like, are words of convenience and are not to be construed as limiting.

The compositions and methods of the present invention can comprise, consist of, or consist essentially of the essential elements and limitations of the invention described herein, as well as any additional or optional ingredients, components, or limitations described herein or otherwise useful in compositions and methods of the general type as described herein.

Numerical ranges as used herein are intended to include every number and subset of numbers contained within that range, whether specifically disclosed or not. Further, these numerical ranges should be construed as providing support for a claim directed to any number or subset of numbers in that range or to be limited to the exact conversion to a different measuring system, such, but not limited to, as between inches and millimeters.

All references to singular characteristics or limitations of the present invention shall include the corresponding plural characteristic or limitation, and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

DETAILED DESCRIPTION OF THE INVENTION

In accordance with the present disclosure, a modular interlocking decorative landscaping system to keep rain away from a foundation is provided. The disclosure is directed to a device and method for keeping rain water away from the foundation of a structure while providing a decorative border between the structure and the grass.

The system may be constructed from a polymer material or other light-weight material and or recycled materials (e.g., recycled polypropylene, or other materials), rubber, and or a combination thereof.

Figure 1:
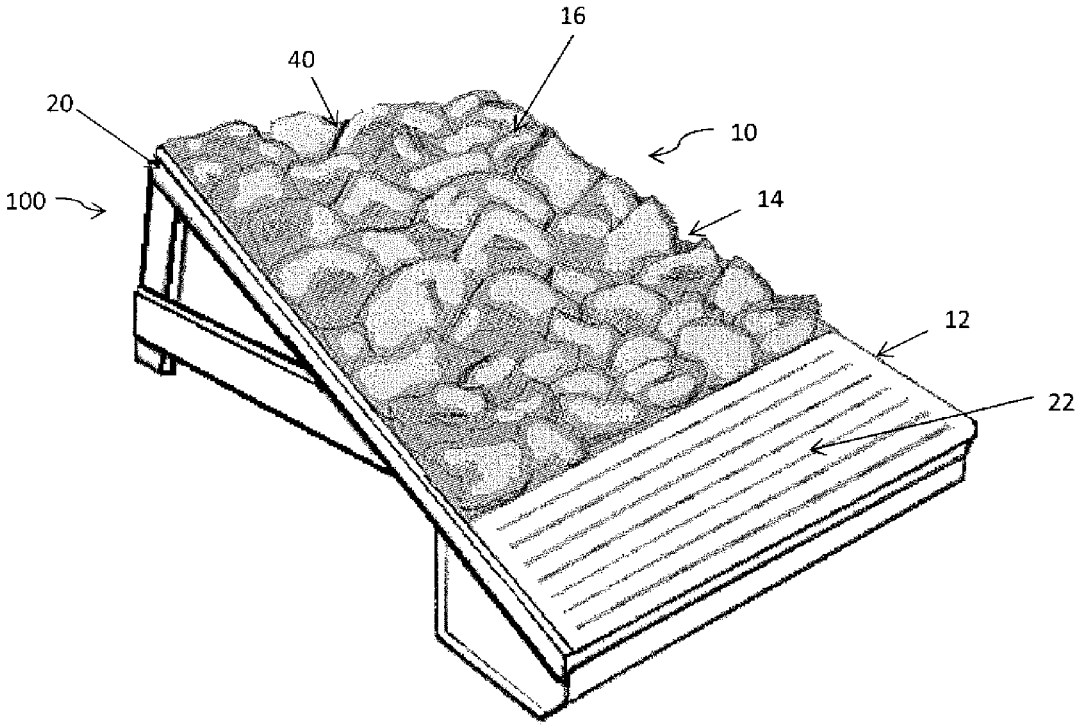
FIG. 1 is a perspective view of a unit of the invention.

As depicted in the embodiment shown in FIG. 1, each unit 10 includes an angled surface panel 14 with a drain section 12, each of which connect with adjacent panels and drains when installed. Each unit 10 comprises a frame 100 (also see FIG. 3).

Each unit 10 is sized to be assembled with adjoining units. The surface panels connect to form a seamless border and the drain sections, when interconnected, form a conduit at the base of the surface panel.

Surface panel 14 comprises a water barrier layer 20 and a decorative feature 16. Feature 16 is preferably formed in a repeating pattern across the panel 14. Feature 16 may be formed from a polymer material or other light-weight material capable of being molded and for diverting water to the drain section. The feature 16 is shaped to resemble real mulch (which can be colored, such as red or black), lava rock, rocks, pebbles, brick, slate, or some popular form of landscaping.

Figure 2:
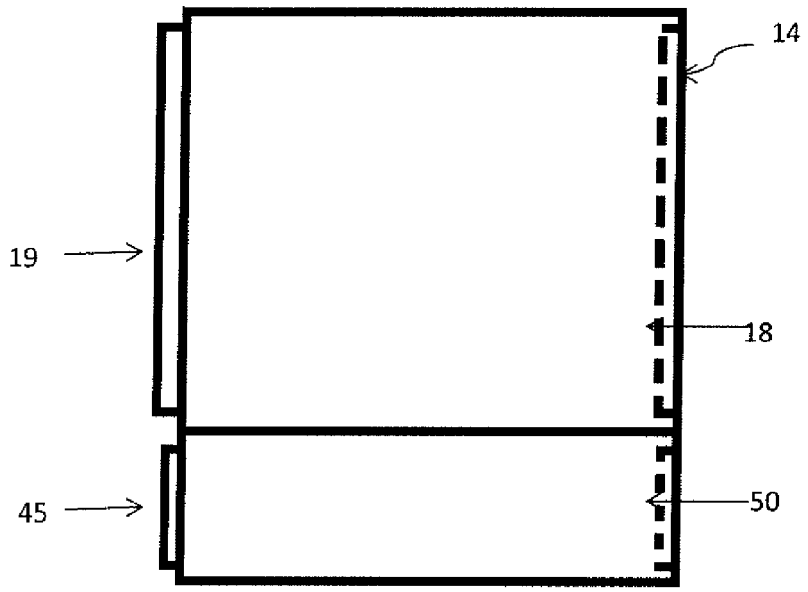
FIG. 2 is a top view of a panel.

Referring to FIG. 2, surface panel 14 includes an interlocking slot portion 18 that is configured to receive a tab 19 from an adjacent surface panel 14 of another unit 10. Interlocking portions 18 form a slot configured to receive the tab 19 of an adjacent surface panel 14. It should be understood that other configurations for the interlocking portions 18 may be employed. Interlocking portions 18 prevent shifting of the surface panels 14 after installation, and create a continuous feature 16. Advantageously, seams that may appear in other systems are not visible in the present invention. The border of the present modular system appears as a seamless surface during all seasons.

Each unit 10 includes a water barrier layer 20 which is configured to permit water to reach the drain section 12. The water barrier may be flexible or ridged and part of or separate from the feature. The feature 16 is configured on the water barrier to form channels 40. The channels facilitate the flow of water into holes 22 in the top of the drain. It should be understood that each panel 14 may include a plurality of channels 40 that permit water to flow into a plurality of holes 22. The holes 22 allow the water to flow into the drain section and away from the foundation. In an embodiment, the water barrier layer is from about 4" to about 12 feet long. In an embodiment, the water barrier layer is from about 4" to about 6 feet wide. In an embodiment the water barrier is 24 inch long by about 36 inch wide (away from the building), although any sized footprint may be employed. The 24" by 36" footprint provides a workable border section (standard wall panels are 12 feet long) while maintaining a reasonable weight so that the unit 10 may be easily transported by a worker or other individual. Other unit lengths include but are not limited to 12", 18", 24", 36" and 42". In an embodiment, the feature 16 is flexible and provided in rolls of 20-50 feet.

The size of drains 12 can be designed to receive more or less water as the particular conditions permit in a given climate, conditions or environment. Drains range from about 2" to about 6" in diameter. In an embodiment, the drain is a 4" covered duct. The cover 20 is engineered to draw rainwater in, while preventing leaves and debris from entering. The cover 20 may be sloped from the panel 14 to the ground, or may be flat. The slope may be the same as the slope of the panel or it may be slope lesser than the slope of the panel. The drain has a low profile with the ground so it is not an obstacle for mowing.

In an embodiment, the drain is made from durable, heavy grade aluminum (0.027 gauge) with a baked enamel paint finish for durability in extreme weather conditions. Holes can be round openings or slits.

Drains 12 are preferably closed-top conduits although open drains may be employed. As depicted in FIG. 2, each drain has a male end 45 that slips into a female end 50. In an end cap unit, an end of the drain is closed to prevent water from exiting that side.

Factors which affect proper drainage are slope, drain size, and placement of outlets. The sizing of drains must be large enough to quickly carry away all water entering the drains. Specific areas of the system can have the connected drains slope to drain water by gravity. Outlets 200 (FIG. 6*c*) from the drains are placed about 50 feet apart. Each 50 foot border should have at least one drain.

Figure 3:
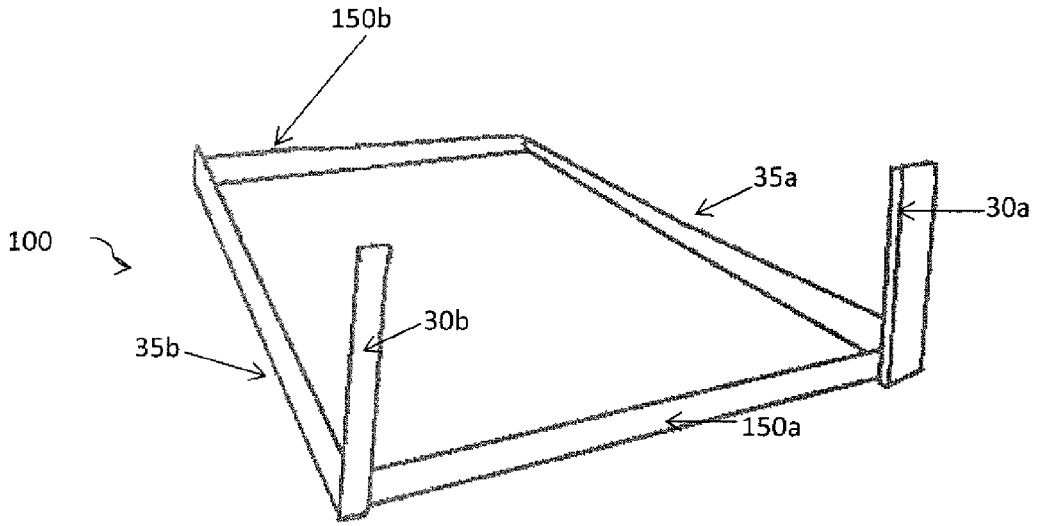
FIG. 3 is a perspective view of a frame of the invention.
Figure 4A:
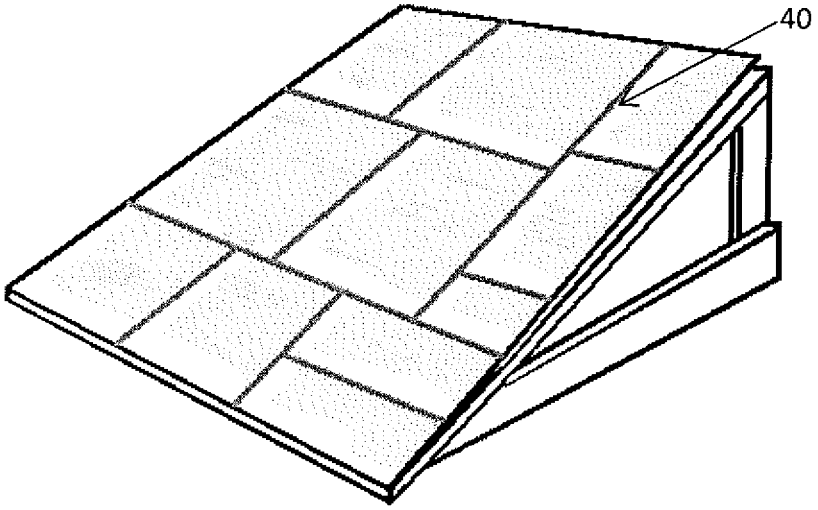
FIGS. 4*a* and 4*b* are perspective views of alternate embodiments of a feature connected to a frame.
Figure 4B:
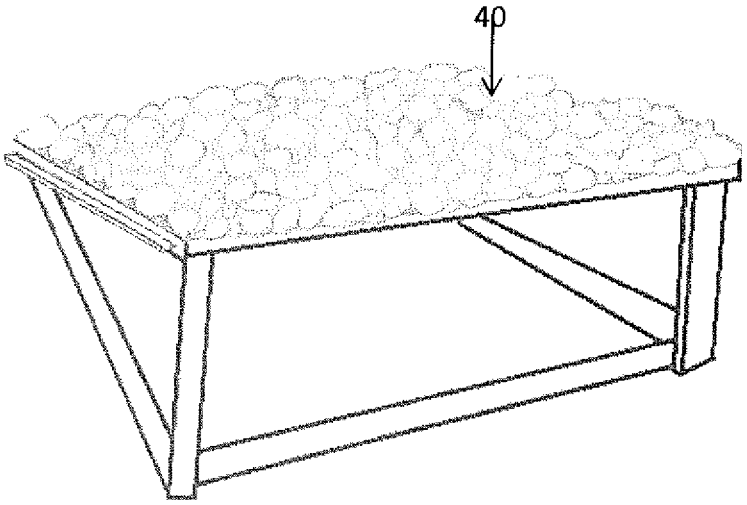
Figure 5A:
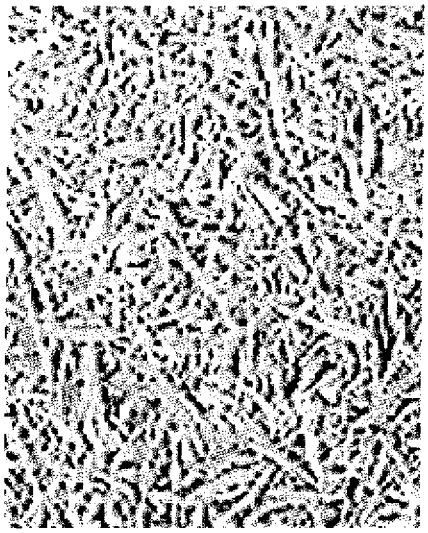
FIGS. 5*a* and 5*b* are top views of alternate embodiments for the feature.
Figure 5B:
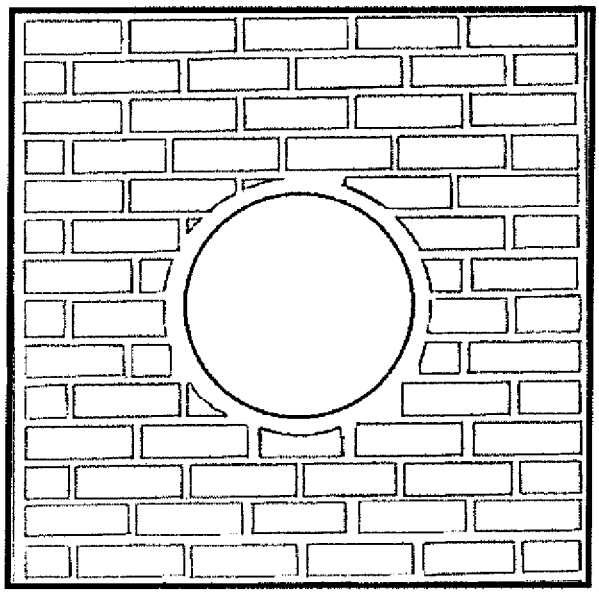

The frame 100 is a separate part of the unit from the panel, so that panels may be preplaced or updated to a new feature. As depicted in FIG. 3, frame 100 comprises two vertical supports 30*a* and 30*b*, at least two horizontal support 35*a* and 35*b*, and two connectors 150*a* and 150*b*. The vertical supports are spaced apart by a first connector 150*a* to form a frame length from about 4" to about 12 feet. In an embodiment, the frame is about 24 inches. The 24" span provides support so the panel does not sag after exposure from the elements. Other unit lengths include but are not limited to 12", 18", 24", 36" and 42". Each horizontal support 35*a* and 35*b* extend from each vertical support at opposite ends near the end of the vertical support that rests on the ground. Each horizontal support is connected by a second connector 150*b*. In an embodiment, the second connector 150*b* is the same length as the first connector 150*a*. Alternatively, the second connector is shorter, longer or includes a curve or angle to accommodate the border going around a corner or curve of the structure.

The supports 30, 35 provide stability to the unit. An underside of the water barrier layer 20 is adapted to connect to each of the connectors. In an embodiment, the water barrier and or the feature are connected to the frame at the connectors with a releasable connecting means such as magnets, hooks, clamps, clips, clasps, straps, nut and bolts, self-tapping screws and the like.

A height of the top of the surface panel (the portion nearest the foundation) can vary based on the building, the eaves, the height of the block, and the like. In an embodiment, the height at the top of the surface panel is about 8", sloping away from the building at a distance of about 36" to a base of the panel that is about 0 to ½" above grade. The base connects to the drain. The drain may be located at or below grade.

The length of the vertical supports 30*a* and 30*b*, determines the height of the surface panel against the building. The height of the support panel plus the depth of the water barrier layer 20 and the width of the unit (distance from the building) determines the slope of the panel 14. The slope of the panel 14 is about 10% to about 40%. In an embodiment, the slope is about 22%. Greater slope provides more surface runoff. In an embodiment the channels are designed to impede runoff. Providing channels in a steeper slope allows heavy rain to enter the holes of the drain without washing over the holes.

In an embodiment, the panel comprises an electrical circuit. In an embodiment, the circuit connects a solar panel to an battery. In an embodiment, the electrical circuit comprises a light emitting unit that projects light onto the structure. In an embodiment, the light emitting is a holiday lighting component.

Figure 6A:
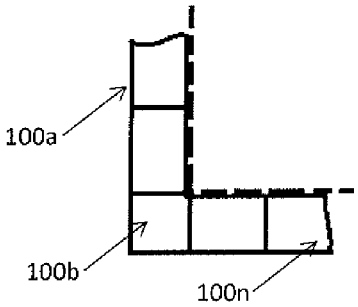
FIG. 6*a* is a top view diagram of an embodiment of the invention bordering a corner of a structure.
Figure 6B:
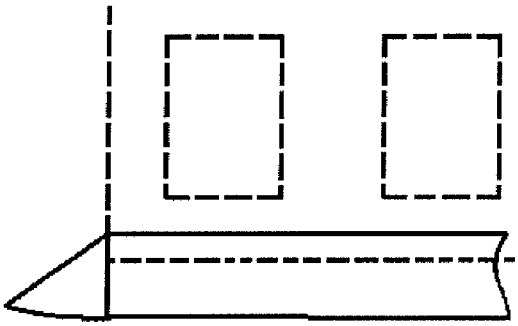
FIG. 6*b* is a front view diagram of an embodiment of the invention bordering a structure.
Figure 6C:
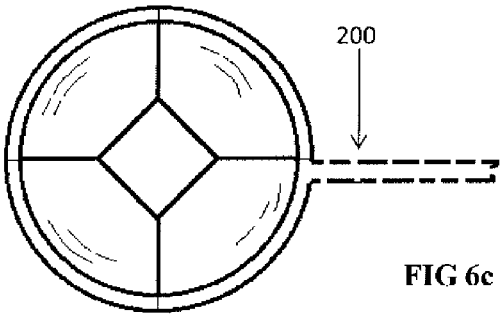
FIG. 6*c* is a top view of an alternate embodiment of the invention bordering a round structure and depicting an outlet for the drain.

As depicted in FIGS. 6*a*-6*c*, during installation, a first frame 100*a* is placed at the structure, such as a foundation of a building, a wooden or concrete pole, a stature, a garden sculpture, and the like, with the vertical supports 30 nearest the wall of the building. The modular units are pre-configured to span a desired length and surround corners of the structure. The frame may be fastened to the structure via any fastening means, such as screws, anchors and or fasteners. A next unit is connected, corner units 100*b* are used for corners of the building, and more units 100*n* are placed until the border is at the desired length and or the structure is surrounded. The frames are interconnected and optionally connected to the structure. The water barrier and feature (selected by the owner) are attached to the frames and the panels are interlocked to form a continuous barrier to rain. The rain falls on the surface and is moved by gravity to the drain at the ground end and, if the drain is under grade, it also diverts the runoff water from surrounding areas into the drain and away from the house. The modular system provides that the frame or section of the barrier layer or feature can be replaced if damaged or to change the look of the border, add a plant, etc. The surface panels 14 are easily removed to provide access to the ground below. In an embodiment depicted in FIG. 6*c*, the units are used around a circular object, such as a cement barrier.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. Additional features of the invention will become apparent to those skilled in the art upon consideration of the description. Modifications may be made without departing from the spirit and scope of the invention.

I claim:

1. A modular landscaping and waterproofing system comprising a plurality of units adapted to be interconnected in a side by side relationship to form a continuous upper surface and divert rain water from a foundation of a structure, each unit comprising:

a) a panel comprising a waterproof barrier layer, a feature, and releasable coupling means, the panel having a first end and a second end, the second end connected to a drain section, the drain section having a cover, the releasable coupling means interconnecting a first panel to a second panel to form the continuous upper surface; and b) a frame, the frame angled from a top part to a bottom part and supporting the first end of the panel about adjacent to an outside of the structure at a preselected elevation from ground level and supporting the second end of the panel at about ground level at a preselected distance from the structure; and wherein a plurality of channels created by a configuration of the feature directs water hitting the feature to flow into a plurality of holes in the cover of the drain section.

2. The system of claim 1 wherein the frame comprises releasable connection means to interconnect a first frame to a second frame.

3. The system of claim 1 further comprising an opening in the panel; the opening shaped to allow a plant rooted in the ground to receive sunlight and rain.

4. The system of claim 1 further comprising an electrical circuit.

5. The system of claim 1 wherein the panel is fabricated from a material selected from the group a plastic, a cementitious material, a metal and a solar panel.

6. The system of claim 1 wherein the feature is shaped to resemble a foundation covering selected from the group mulch, rocks, pebbles, bricks, patterned cement, slate and stucco.

7. The system of claim 4 wherein the panel comprises a light emitting unit connected to the electrical circuit.

8. The system of claim 1 wherein the coupling means comprises a male coupling part and a female coupling part.

9. The system of claim 8 wherein the male coupling part is molded on a first side of the panel and the female coupling part is a slot in the opposite side of the panel and the panels are connected in a side by side fashion.

10. The system of claim 2 wherein the connection means is selected from the group consisting of a magnet, a hook, a clamp, a clip, a clasp, a strap, a screw, and a nut and bolt.

11. The system of claim 1 wherein the is a solar panel connected to a battery.

12. The system of claim 1 wherein each drain section has a male end and a female end, and, when the panels are connected, the male end of a first drain section interconnects with the female end of a second drain section to form a conduit, the conduit located at about ground level.

13. The system of claim 12 wherein the conduit comprises an opening that is connected to at least one outlet.

14. The system of claim 1 wherein the frame has a first connector and a second connector, a length of the first connector determining the length of the frame at the structure and, a length of the second connector is one of longer than the first connector or curved.

15. The system of claim 1 wherein the frame comprises means to connect the frame to the structure.

16. The system of claim 7 wherein the light emitting unit is a holiday lighting component.

17. The system of claim 14 wherein the second connector is curved and the structure is a circular object.

* * * * *

UNITED STATES PATENT AND TRADEMARK OFFICE

CERTIFICATE OF CORRECTION

PATENT NO. : 9,267,278 B1
APPLICATION NO. : 14/750014
DATED : February 23, 2016
INVENTOR(S) : James Gibson It is certified that error appears in the above-identified patent and that said Letters Patent is hereby corrected as shown below:

In the Claims

Claim 11, column 6, line 40, after "wherein the" insert --panel--.

Signed and Sealed this
Fourteenth Day of June, 2016

Michelle K. Lee

Michelle K. Lee
*Director of the United States Patent and Trademark Office*